US005112732A

United States Patent [19]

Hayashi, deceased et al.

[11] Patent Number: 5,112,732

[45] Date of Patent: May 12, 1992

[54] DIRECT POSITIVE SILVER HALIDE PHOTOGRAPHIC MATERIALS

[75] Inventors: Kazunori Hayashi, deceased, late of Hikone; Masahiro Hayashi, heir; Masako Hayashi, heir, both of Nara, all of Japan

[73] Assignee: Fuji Photo Film Co., Ltd., Kanagawa, Japan

[21] Appl. No.: 500,350

[22] Filed: Mar. 28, 1990

[30] Foreign Application Priority Data

Mar. 31, 1989 [JP] Japan ..... 1-80492

[51] Int. Cl.[5] ..... G03C 1/485

[52] U.S. Cl. ..... 430/596; 430/597; 430/598; 430/378; 430/410; 430/547; 430/569; 430/604

[58] Field of Search ..... 430/604, 598, 547, 569, 430/410, 378, 596, 597

[56] References Cited

U.S. PATENT DOCUMENTS

| | | | |
|---|---|---|---|
| 3,672,901 | 6/1972 | Ohkubo et al. | 430/569 |
| 4,395,478 | 7/1983 | Hoyen | 430/603 |
| 4,806,462 | 2/1989 | Yamashita et al. | 430/604 |
| 4,857,450 | 8/1989 | Burrows et al. | 430/603 |
| 4,933,265 | 6/1990 | Inoue et al. | 430/547 |
| 4,933,272 | 6/1990 | McDugle et al. | 430/605 |
| 4,981,780 | 1/1991 | Inoue et al. | 430/598 |

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

A direct positive silver halide photographic material is disclosed, comprising a support having thereon at least one internal latent image silver halide emulsion layer which has not been prefogged and another hydrophilic colloid layer wherein the grains in the internal latent image silver halide emulsion is formed in the presence of an iron complex compound. The direct positive silver halide photographic material is developed and then direct positive images may be obtained with this material, which feature a high $D_{max}$ and a low $D_{min}$. The disclosed material has a broad range of applications, including as a COM film.

6 Claims, No Drawings

DIRECT POSITIVE SILVER HALIDE PHOTOGRAPHIC MATERIALS

FIELD OF THE INVENTION

The present invention concerns silver halide photographic materials with which direct positive images can be formed rapidly using highly stable processing baths and a method for forming images in which these materials are used. In particular it concerns photosensitive materials which are used in films for computer output purposes (COM purpose films) and a method for forming images in which these materials are used.

BACKGROUND OF THE INVENTION

The rapid development of computers has resulted in an increased information industry, and a substantial amount of research has been devoted to developing methods for improving the output of large amounts of recorded data. Silver halide photographic materials which are compatible with reversal processing are used as recording materials in this field. The processing step in the reversal development method involves the formation of a negative image by means of a first development process. The negative image is then subjected to a bleaching process without a fixing process, and the reduced silver of the negative image is removed. The residual undeveloped silver halide is then exposed and a positive image is formed by performing a second development. However, the processing step of this method is complicated and the rate at which the finished film is obtained is low. Additionally fluctuations are likely to arise in the maximum density ($D_{max}$) and the minimum density ($D_{min}$) of the film. Moreover, a powerful bleaching agent, such as potassium dichromate, must be used in the bleaching bath, causing pollution problems.

The photographic method by which direct positive images are obtained without the need for a reversal processing step or a negative film is well known as a means of avoiding problems of this type.

The methods used to form positive images with conventional direct positive silver halide photographic materials divide essentially into two main types, omitting special cases.

The first type of method involves the use of a prefogged silver halide emulsion in which the fog nuclei (latent image) in the exposed parts are destroyed by means of solarization or a Herschel effect, for example, and a direct positive image is obtained after development.

In the other type of method, an internal latent image type silver halide emulsion which has not been prefogged is used. After imagewise exposure, these materials are subjected to surface development either after a fogging step or during a fogging step, and a direct positive image is obtained.

The photosensitive nuclei of internal latent image type silver halide photographic emulsions are principally within the silver halide grains. Further, the latent image, on exposure, is formed principally within the grains.

The latter method generally has a higher photographic speed than the former method and therefore can be used in applications in which high speeds are required. The present invention is concerned with methods of this later type.

Various techniques are already known in this field of technology. For example, disclosures have been described principally in the specifications of U.S. Pat. Nos. 2,592,250, 2,466,957, 2,497,875, 2,588,982, 3,317,322 (2,497,875), 3,761,266, 3,761,276 and 3,796,577, and British Patents 1,151,363 and 1,150,553 (1,011,062). Comparatively fast photographic photosensitive materials of the direct positive type can be made using these known methods.

Furthermore, details of the mechanism by which direct positive images are formed is disclosed, for example, in T.H. James, *The Theory of the Photographic Process*, Fourth Edition, Chapter 7, pages 182 to 193, and in U.S. Pat. No. 3,761,276.

Thus, fog nuclei are produced selectively only on the surface of the silver halide grains in the unexposed areas because of the surface desensitizing action which results from the internal latent image which has been formed within the silver halide grains as a result of the initial imagewise exposure. A photographic image (a direct positive image) can usually be formed in the unexposed parts by a surface development process.

Known means of forming fog nuclei selectively as mentioned above include the so-called light fogging methods in which the whole surface of the photosensitive layer is subjected to a second exposure (for example, British Patent 1,151,363) and chemical fogging methods in which nucleating agents are used. The latter methods have been disclosed, for example, in *Research Disclosure*, Vol. 151, No. 15162 (published November 1976), pages 72 to 87.

The conventional chemical fogging methods are such that high pH values of 12 or above are used initially to realize the effect of the nucleating agent, and so deterioration of the developing agent due to aerial oxidation is likely to occur under these high pH conditions. There is consequently the disadvantage of a pronounced loss of development activity. There is a further disadvantage in that the rate of development is slow and the processing time is prolonged, and an especially long processing time is required, when low pH development baths are used.

On the other hand, in the case of the light fogging method, there is no need for high pH conditions, which is comparatively useful in practice. However, there are various technical problems because of the wide purpose of photographic fields in which these materials are used. That is to say, the light fogging method is based on the formation of fog nuclei resulting from the photodegradation of silver halides and so there are differences in the appropriate exposure intensity and exposure level, depending on the type of silver halide which is being used and its characteristics. Consequently, it is difficult to achieve a constant level of performance, and there is the further disadvantage that the developing apparatus is complicated and expensive. There is also the disadvantage that the processing time is prolonged.

Thus, it is difficult to obtain good direct positive images in a stable manner using the conventional fogging methods. Compounds which exhibit a nucleating action at pH values of less then 12 have been suggested in JP-A-52-69613 and U.S. Pat. Nos. 3,615,615 and 3,850,638 as a means of resolving these problems, but these nucleating agents act upon the silver halide during storage of the sensitive materials prior to processing. Further, they are themselves degraded, and so there is the disadvantage that the maximum image density after processing is in fact reduced. (The term "JP-A" as used herein signifies an "unexamined published Japanese patent application".)

The use of hydroquinone derivatives to increase the development rate of medium densities has been disclosed in U.S. Pat. No. 3,227,552. However, the rate of development is still inadequate even when these derivatives are used and, in particular, only inadequate rates of development can be attained with development at pH of less than 12.

Furthermore, the addition of mercapto compounds which contain carboxylic acid groups or sulfonic acid groups to increase the maximum image density has been disclosed in JP-A-60-170843. However, the effect of adding these compounds is slight.

Reduction of the minimum image density and prevention of the formation of re-reversal negative images by processing in processing baths (pH 12.0) which contain tetrazaindene based compounds in the presence of nucleating agents has been described in JP-A-55-134848. However, in this method neither the maximum image density nor the rate of development is high.

Furthermore, the addition of triazolinthione or tetrazolinthione based compounds as anti-foggants to sensitive materials with which direct positive images are formed using a light fogging method has been disclosed in JP-B-45-12709. (The term "JP-B" as used herein signifies a "examined Japanese patent publication".) However, it is not possible even with this method to achieve high maximum image densities and rapid development rates.

Thus, as yet there is no technique for obtaining in a short period of time a direct positive image which has a high maximum image density and a low minimum image density.

Furthermore, there is the general problem that re-reversal negative images are often formed in high speed direct positive emulsions with high exposure levels (i.e., high exposure intensity). The prevention of re-reversal negative image formation is especially important with the high intensity exposures which arise from short exposures and the high speeds required for COM purpose films.

Techniques for overcoming the aforementioned problems have been disclosed in JP-A-60-73625, JP-A-60-443, JP-A-63-8704 and JP-A-63-106656, but these methods can not prevent the formation of re reversal negative images.

SUMMARY OF THE INVENTION

One object of the present invention is to provide internal latent image type silver halide photo graphic materials which have not been pre-fogged, which are developed in the presence of nucleating agents, and with which direct positive images having a high $D_{max}$ and a low $D_{min}$ can be formed rapidly and in a stable manner.

A second object of the present invention is to provide direct positive silver halide photographic materials for COM film purposes in which internal latent image type silver halide emulsions which have not been pre-fogged, and reversal due to nucleating agents, are employed.

A third object of the present invention is to provide direct positive silver halide photographic materials with which there is little occurrence of re-reversal negative image formation eve when high intensity exposures are used.

These and other object have been realized by means of a direct positive silver halide photographic material comprising a support having thereon at least one an internal latent image type silver halide emulsion layer which has not been pre-fogged and another hydrophilic colloid layer, wherein the grains in the internal latent image type silver halide emulsion are formed in the presence of an iron complex compound.

DETAILED DESCRIPTION OF THE INVENTION

The iron complex compound used in the present invention is, for example, potassium ferrocyanide, $K_4[Fe(CN)_6]\cdot 3H_2O$; potassium ferricyanide, $K_3[Fe(CN)_6]$; or an EDTA iron complex salt. The amount of the iron complex compound added is preferably $1\times10^{-9}$ to $1\times10^{-2}$ mol, and more preferably $1\times10^{-6}$ to $1\times10^{-4}$ mol, per mol of silver halide. Furthermore, two or more of these compounds can be used conjointly.

The time at which these compounds are added can be at any stage during the manufacture of the internal latent image type silver halide emulsion which it is not pre-fogged. That is to say, the addition can be made at any stage during the core grain nuclei formation, the core grain growth, the chemical ripening of the core grains, or the growth of the shell which covers the cores during the manufacture of the internal latent image type silver halide grains which are not pre-fogged. Incorporation of the iron complex compound into the silver halide grains is especially desirable, and its incorporation into the silver halide grains during shell growth is most desirable of all. The incorporation of iron in the form of ferrous chloride into internal latent image type silver halide grains which are not pre-fogged has been suggested in JP-A-63-191145 to improve processing dependence. But the effect of the iron complex compounds and not the iron salts (i.e., the action in which the contrast and sensitivity at the toe portion in the characteristic curve of the direct reversal photosensitive material is increased) in suppressing markedly the re-reversal negative image formation in high intensity exposures could not have been predicted.

The internal latent image type silver halide emulsions which have not been pre-fogged which are used in the present invention contain silver halides in which the surface of the grains has not been pre-fogged and in which the latent image is formed principally within the grains. When these silver halide emulsions are coated at a fixed rate on a transparent support, the maximum density (measured by the normal method for measuring photographic density on exposure for a set time of 0.01 to 10 seconds and on development for 6 minutes at 20° C. in an internal Developer A, the composition of which is indicated below) is preferably at least five times, and most preferably at least ten times, the maximum density obtained by coating the same amount of the emulsion and developing the silver halide emulsion exposed in the same way as above for 5 minutes at 18° C. in surface Developer B, the composition of which is indicated below.

| | |
|---|---|
| Surface Developer B | |
| Metol | 2.5 grams |
| L-Ascorbic acid | 10 grams |
| $NaBO_2.4H_2O$ | 35 grams |
| KBr | 1 gram |
| Water to make | 1 liter |
| Internal Developer A | |
| Metol | 2 grams |

-continued

| | |
|---|---|
| Sodium sulfite (anhydrous) | 90 grams |
| Hydroquinone | 8 grams |
| Sodium carbonate (mono-hydrate) | 52.5 grams |
| KBr | 5 grams |
| KI | 0.5 gram |
| Water to make | 1 liter |

The core/shell type silver halide emulsions and conversion type silver halide emulsions disclosed, for example, in British Patent 1,011,062, and U.S. Pat. Nos. 2,592,250 and 2,456,943 can be cited as examples of internal latent image type emulsions, and the emulsions disclosed, for example, in JP-A-47-32813, JP-A-47-32814, JP-A-52-134721, JP-A-52-156614, JP-A-53-60222, JP-A-53-66218, JP-A-53-66727, JP-A-55-127549, JP-A-57-136641, JP-A-58-70221, JP-A-59-208540, JP-A-59-216136, JP-A-60-107641, JP-A-60-247237, JP-A-61-2148, JP-A-61-3137, JP-B-56-18939, JP-B-58-1412, JP-B-58-1415, JP-B-58-6935, JP-B-58-108528, JP-A-62-194248, U.S. Pat. Nos. 3,206,313, 3,317,322, 3,761,266, 3,761,276, 3,850,637, 3,923,513, 4,035,185, 4,395,478 and 4,504,570. European Patent 0067148 and *Research Disclosure* RD 16345 (November 1977) can be cited as examples of the said core/shell type emulsions.

The composition of the silver halide includes a mixed silver halide such as a silver chlorobromide, a silver chloroiodobromide, or a silver iodobromide, as well as a silver chloride and a silver bromide. The silver halides used in the present invention are preferably silver chloro(iodo)bromides, silver (iodo)chlorides or silver (iodo)bromides which contain no silver iodide at all or, if it is included, not more than 3 mol% of silver iodide based o the total silver halide content.

The average grain size of the silver halide grains (the average grain diameter in the case of grains which are spherical or approaching spherical, or of the edge length in the case of cubic grains, being based on the projected area) is preferably from 0.1 to 2.0 μm, and more preferably from 0.15 to 1.0 μm. The grain size distribution may be narrow or wide, but the use of so-called mono-disperse emulsions which have a narrow grain size distribution such that at least 90%, and preferably at least 95%, of all the grains in terms of the number or weight of grains are of a size within ±40% (more preferably within ±30%, and most preferably within ±20%) of the average grain size is preferred in the present invention to improve graininess and sharpness. Furthermore, two or more mono-disperse emulsions which have different grain sizes, or a plurality of grains which have the same grain size but different photographic speeds, may be mixed in the same layer or lamination-coated in separate layers in emulsion layers which have essentially the same color sensitivity to satisfy the gradation requirements which are one of the features of photosensitive materials. Moreover, two or more types of poly-disperse emulsion, or combinations of monodisperse emulsions and poly-disperse emulsions, can be mixed together or laminated in the present invention.

The form of the silver halide grains used in the present invention may be a regular crystalline form such as a cubic, octahedral, dodecahedral or tetradecahedral form, or an irregular crystalline form such as a spherical form. These grains may have a form which is a composite of these crystalline forms. Furthermore, they may be tabular grains. Emulsions, in which tabular grains having a length/thickness ratio of preferably at least 5, and more preferably at least 8, account for at least 50% of the projected area of all the grains, can be used. The emulsions may also comprise mixtures of the various crystalline forms.

The silver halide emulsions of the present invention can be prepared in the presence of silver halide solvents. The organic thioethers disclosed, for example, in U.S. Pat. Nos. 3,271,157, 3,531,289 and 3,574,628, JP-A-54-1019 and JP-A-54-158917, and the thiourea derivatives disclosed in JP-A-53-82408, JP-A-55-77737 and JP-A-55-2982 are used as silver halide solvents.

The silver halide emulsions of the present invention can be chemically sensitized within the grains or on the grain surface using sulfur or selenium sensitization, reduction sensitization or noble metal sensitization, for example, either independently or conjointly.

The direct positive silver halide emulsions of the present invention can provide, after imagewise exposure, good direct positive images when subjected to surface development in the presence of a nucleating agent.

The preferred nucleating agents of the present invention are compounds which can be represented by formula [I] indicated below:

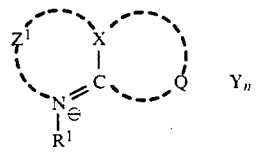

[I]

wherein $Z^1$ in formula [I] represents a group of non-metal atoms which is required to form a five or six membered heterocyclic ring. Examples of the non-metal atoms include C, N, S, O and Se. This heterocyclic ring may be condensed with an aromatic ring or a heterocyclic ring. $R^1$ represents an aliphatic group (preferably having 1 to 18 carbon atoms), and X represents =C- or

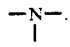

Q represents a group of non-metal atoms which is required to form a four to twelve membered non-aromatic hydrocarbon ring or non-aromatic heterocyclic ring. Examples of the non-metal atoms include C, N, S, O and Se. However, at least one of the substituent groups of $R^1$ and $Z^1$, and of the substituent group of Q, contains an alkenyl group (particularly preferably having 3 carbon atoms). Moreover, at least one of $R^1$, $X^1$ and Q may have a group which promotes adsorption on silver halides. Y represents a counter ion for balancing the electrical charge, and n is the number of counter ions required to balance the electrical charge.

The compounds represented by formula (I) which can be used in the present invention are preferably used in an amount of from $1\times10^{-7}$ to $1\times10^{-5}$ mol per mol of the silver halide.

Examples of these compounds and methods for their preparation have been disclosed, for example, in JP-A-1-224758 (corresponding to European Patent Application No. 331185A) and in the patents and literature cited in that application.

Specific examples of compounds which can be represented by general formula [I] are indicated below, but the invention is not limited by these examples.
(I-1)
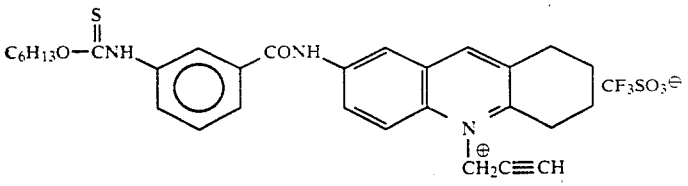
(I-2)
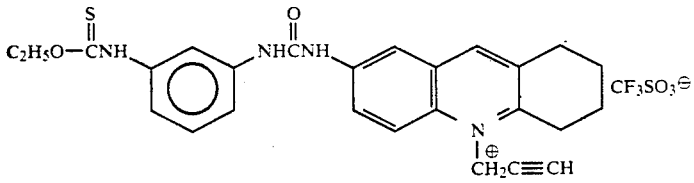
(I-3)
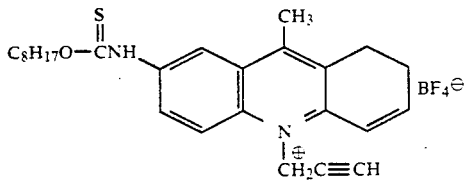
(I-4)
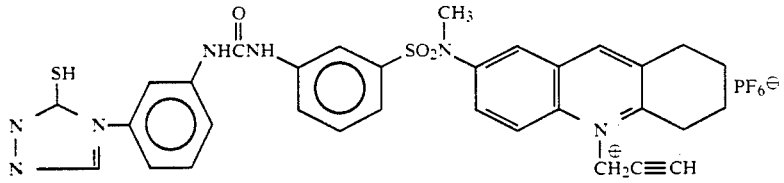
(I-5)
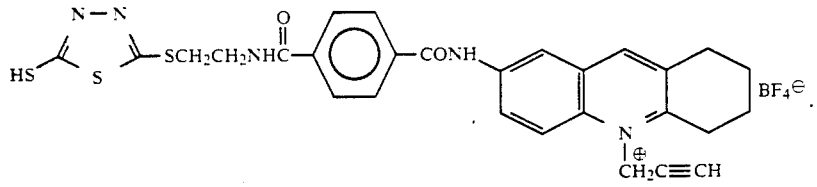
(I-6)
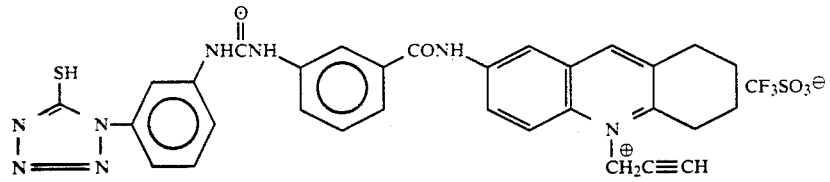
(I-7)
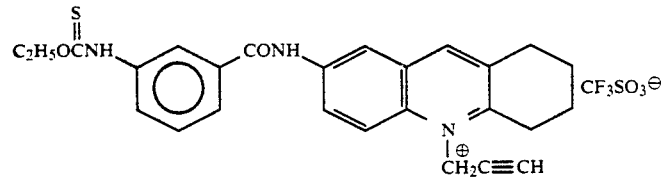
(I-8)
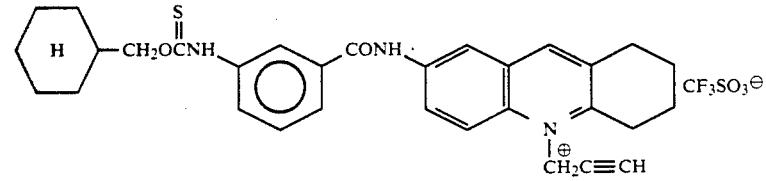

-continued (I-9)

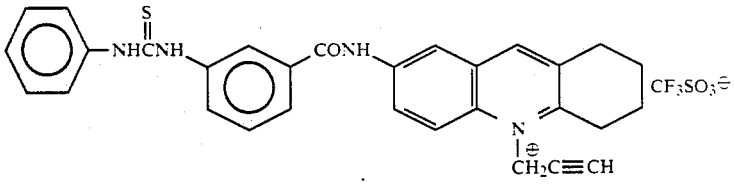

(I-10)

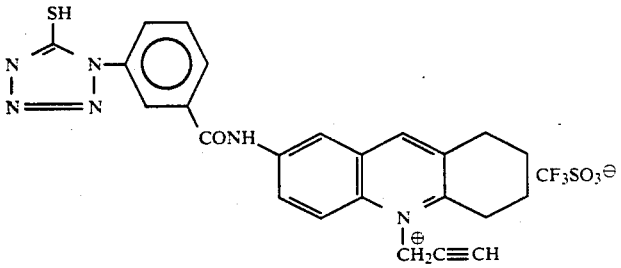

Furthermore, nucleation accelerators which have essentially no function as nucleating agents but which accelerate the action of nucleating agents can be used for increasing the maximum density of the direct positive image and/or for shortening the development time required to obtain a fixed direct positive image density.

The nucleation accelerators which can be used in the present invention are preferably in an amount of from $1\times10^{-4}$ to $1\times10^{-2}$ mol per mol of the silver halide.

Illustrative compounds and methods for their preparation have been disclosed, for example, in JP-A-1-224758 (corresponding to European Patent Application No. 331185A) and in the patents and literature cited in that application.

Specific examples of nucleation accelerators which are useful in the present invention are indicated below, but these compounds are not limited by these examples.

(II-1)

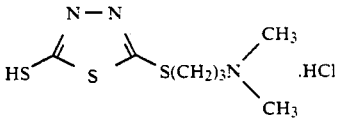

(II-2)

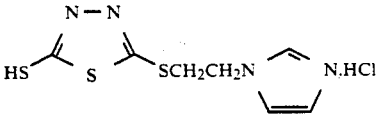

(II-3)

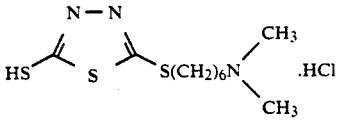

(II-4)

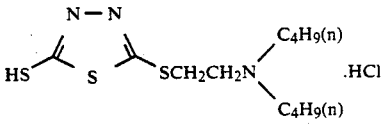

(II-5)

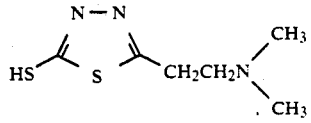

-continued (II-6)

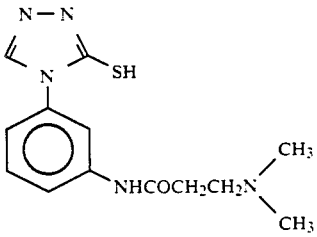

(II-7)

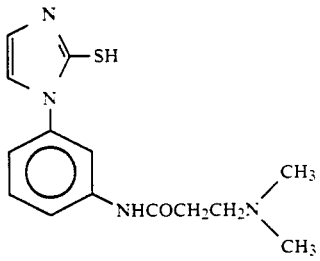

(II-8)

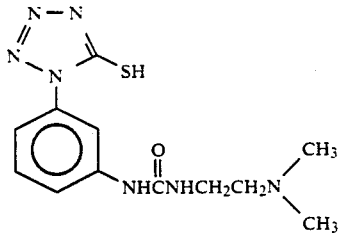

(II-9)

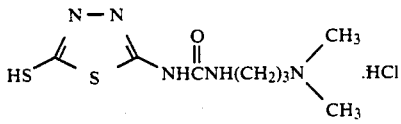

Furthermore, sensitizing dyes which can be represented by formula [III] indicated below can be used for the purpose of spectral sensitization.

[III]

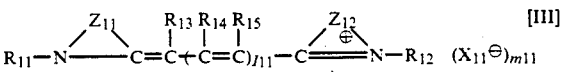

Cyanine dyes, whose longest wavelength absorption peak on silver halide is not more than 590 nm, fall within this formula [III].

In formula [III], $Z_{11}$ and $Z_{12}$ may be the same or different, each representing a group of atoms (for example, C, N, S, O and Se) required for forming a five or six membered nitrogen containing heterocyclic nucleus, and $I_{11}$ represents 0 or 1. The preferred heterocyclic nuclei include, in cases in which $I_{11}$ is zero, thiazole, benzothiazole, naphthothiazole, dihydronaphthothiazole, selenazole, benzoselenazole, naphthoselenazole, dihydronaphthoselenazole, oxazole, benzoxazole, naphthoxazole, benzimidazole, naphthimiaazole, pyridine, quinoline, imidazo[4,5-b]quinoxaline or 3,3-dialkylindolenine. In cases in which $I_{11}$ is 1, $Z_{11}$ preferably represents a heterocyclic nucleus such as thiazoline, thiazole, benzothiazole, selenazoline, selenazole, benzoselenazole, oxazole, benzoxazole, naphthoxazole, imidazole, benzimidazole, naphthimidazole or pyrroline for example, and $Z_{12}$ preferably represents a heterocyclic nucleus such as oxazoline, oxazole, benzoxazole, naphthoxazole, thiazoline, selenazoline, pyrroline, benzimidazole or naphthimidazole for example.

$R_{11}$ and $R_{12}$ may be the same or different, and each represents alkyl groups or alkenyl groups (particularly preferably having 3 carbon atoms), which may be substituted. Their total number of carbon atoms is not more than 10.

$R_{13}$ and $R_{15}$ represent hydrogen atoms. Furthermore, $R_{13}$ and $R_{11}$, and $R_{15}$ and $R_{12}$, may be joined together to form a five or six membered ring.

$R_{14}$ represents a hydrogen atom or a lower alkyl group which may be substituted (for example, methyl, ethyl, propyl, methoxyethyl or phenethyl, and preferably an alkyl group which has not more than 5 carbon atoms).

$X_{11}$ represents an acid anion residual group.

Moreover, $m_{11}$ represents 0 or 1, being 0 in those cases in which an intramolecular salt is formed.

The compounds represented by formula (III) which can be used in the present invention are preferably used in an amount of from $1\times10^{-4}$ to $1\times10^{-2}$ mol per mol of the silver halide.

Examples of the compounds which can be represented by formula [III] are indicated below.

III-1

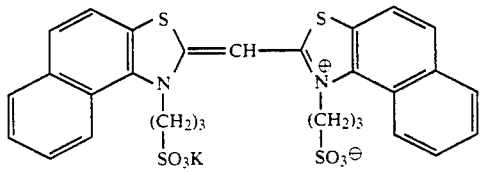

(III-2)

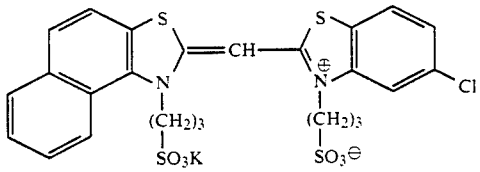

(III-3)

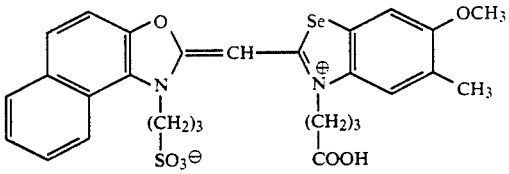

(III-4)

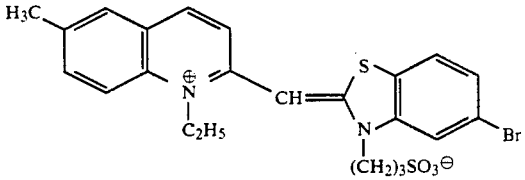

(III-5)

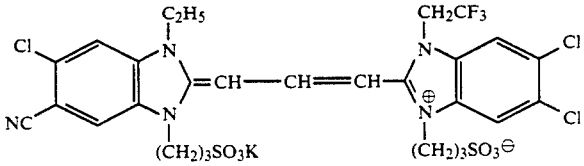

-continued (III-6)

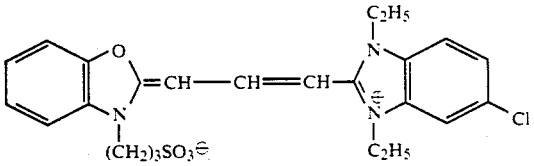

(III-7)

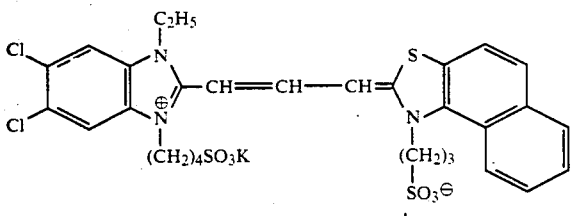

(III-8)

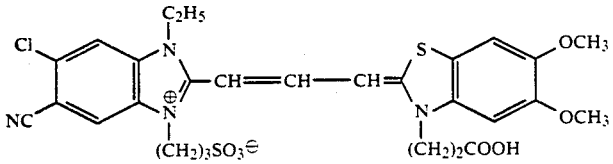

(III-9)

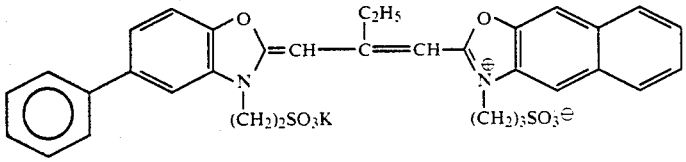

(III-10)

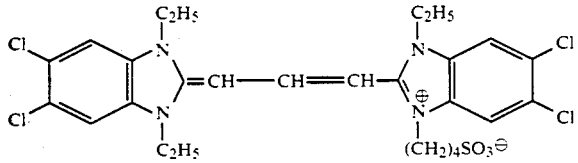

(III-11)

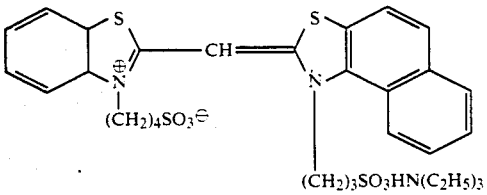

(III-12)

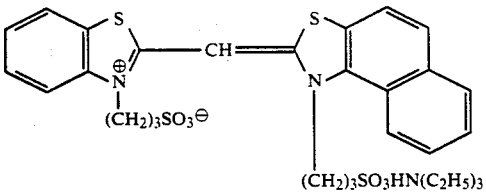

These illustrative compounds and methods for their preparation are disclosed in JP-A-1-224758 (corresponding to European Patent Application No. 31185A) and in the patents and literature cited in that patent.

The sensitizing dyes (for example, cyanine dyes and merocyanine dyes) disclosed on pages 45–53 of JP-A-55-52050 as well as the sensitizing dyes specifically disclosed in the present application can be added to the photosensitive materials of the present invention to increase photographic speed.

These sensitizing dyes can be used individually or they can be used in combination. Combinations of these sensitizing dyes are often used to achieve super-sensitization. Dyes which themselves have no spectrally sensitizing action, or substances which have essentially no absorbance in the visible region, and which exhibit super-sensitization, may be included together with the sensitizing dyes.

Useful sensitizing dyes, combinations of dyes which exhibit super-sensitization and substances which exhibit a super-sensitizing effect have been disclosed in the aforementioned *Research Disclosure*, Vol. 176, No. 17643 (published December, 1978) page 23, sections IV A-J.

Here, the sensitizing dyes etc. can be added in any of the steps in the manufacture of a photographic emulsion, or they can be added after the photographic emulsion has been prepared at any time until immediately before coating. Examples of addition during the manufacture of the emulsion include addition during grain formation, physical ripening and chemical ripening.

Water soluble dyes may be included in the emulsion layer or in other hydrophilic colloid layers of the present invention as filter dyes, for anti-irradiation purposes or for a variety of other purposes. Dyes for further reducing photographic speed are used as filter dyes or dyes which have an absorbance essentially in the 350 nm to 600 nm range in the main are used to increase safety with regard to lighting.

These dyes are preferably used by addition, together with a mordant, to the emulsion layer or to a non-photosensitive hydrophilic colloid layer which is above the silver halide emulsion layer. In other words, the dyes are in a layer further from the support than the silver halide emulsion layer and are fixed in that layer according to their intended purpose.

The amount of dye added differs according to the molar extinction coefficient of the dye, but it is usually within the range of $1\times10^{-2}$ g/m$^2$ to $1\times1$ g/m$^2$. The amount added is preferably within the range of 50 mg/m$^2$ to 500 mg/m$^2$.

Examples of dyes are disclosed in detail in JP-A-63-64039.

Various compounds can be included in the photosensitive materials of the present invention to prevent the occurrence of fogging during the manufacture, storage or photographic processing of the photosensitive material, or to stabilize photographic performance. Thus, many compounds which are known as anti-fogging agents or stabilizers, such as azoles, for example, benzothiazolium salts, nitroindazoles, chlorobenzimid azoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazolinethione; azaindenes such as triazaindenes, tetraazaindenes (especially 4-hydroxy substituted (1,3,3a,7-tetraazaindenes) and pentaazaindenens; benzenethiosulfonic acid; benzenesulfinic acid and benzenesulfonic acid amide can be used for this purpose.

Poly(alkylene oxides) or ether, ester or amide derivatives thereof, thioether compounds, thiomorpholines, quaternary ammonium salt compounds, urethane derivatives, urea derivatives, imidazole derivatives and developing agents such as dihydroxybenzenes or 3-pyrazolidones may be included in the photographic emulsion layers of the photographic materials of the present invention to increase photographic speed, increase contrast or accelerate development. Of these materials, the dihydroxybenzenes (for example, hydroquinone, 2-methylhydroquinone, catechol), and 3-pyrazolidones (for example, 1-phenyl-3-pyrazolidone, 1-phenyl-4-methyl-4-hydroxymethyl-3-pyrazolidone) are preferred. They are normally used at a rate of not more than 5 g/m$^2$. In the case of dihydroxybenzenes, the amount used is preferably 0.01 to 1 g/m$^2$ and, in the case of the 3-pyrazolidones, the amount used is preferably 0.01 to 0.2 g/m$^2$.

Inorganic or organic film hardening agents may be included in the photographic emulsions and non-photosensitive hydrophilic colloids of the present invention. For example, active vinyl compounds (for example, 1,3,5-triacryloyl-hexahydro-s-triazine, bis(-vinylsulfonyl)-methyl ether, N,N'-methylenebis-[$\beta$-(vinylsulfonyl)-propionamide]), active halogen compounds (for example, 2,4-dichloro-6-hydroxy-s-triazine), mucohalogen acids (for example, mucochloric acid), N-carbamoylpyridinium salts (for example, (1-morpholinocarbonyl-3-pyridinio)-methanesulfonate) and haloamidinium salts (for example, 1-(1-chloro-1-pyridinomethylene)pyridinium-2-naphthalenesulfonate) can be used individually or in combinations for this purpose. Among these compounds, the active vinyl compounds disclosed in JP-A-53-41220, JP-A-53-57257, JP-A-59-162546 and JP-A-60-80846, and the active halogen compounds disclosed in U.S. Pat. No. 3,325,287, are preferred.

Various surfactants can be included for various purposes in the photographic emulsion layers or other hydrophilic layers of the photosensitive materials of the present invention. They are, for example, as coating aids or as anti-static agents, to improve sliding properties, for emulsification and dispersion purposes, to prevent sticking and to improve photographic performance (for example, accelerating development, increasing contrast or increasing speed).

Examples of the surfactants include: non-ionic surfactants, such as saponin (steroid based), alkylene oxide derivatives (for example, polyethylene glycol, polyethylene glycol/polypropylene glycol condensate, polyethylene glycol alkylethers or polyethylene glycol alkyl aryl ethers, polyethylene glycol esters, polyethylene glycol sorbitan esters, polyethylene glycol alkyl amines or amides, and poly(ethylene oxide) adducts of silicones), glycidol derivatives (for example, alkenylsuccinic acid polyglyceride, alkylphenyl polyglyceride), fatty acid esters of polyhydric alcohols and sugar alkyl esters; anionic surfactants which include acidic groups (for example, carboxylic acid groups), sulfo groups, phospho groups, sulfate ester groups and phosphate ester groups (for example, alkylcarboxylates, alkylsulfonates alkylbenzenesulfonates, alkylnaphthalenesulfonates, alkylsulfate esters, alkylphospaate esters, N-acyl-N-alkyltaurines, sulfosuccinate esters, sulfoalkylpolyoxyethylene alkylphenyl ethers and polyoxyethylenealkylphosphate esters) amphoteric surfactants (for example, amino acids, aminoalkylsulfonic acids, aminoalkyl sulfate or phosphate esters, alkylbetaines and amine oxides), and cationic surfactants (for example, alkylamine salts, aliphatic and aromatic quaternary ammonium salts, heterocyclic quaternary ammonium salts (for example, pyridinium salts and imidazolium salts), and phosphonium salts and sulfonium salts which contain aliphatic or heterocyclic rings).

Furthermore, the use of the fluorine containing surfactants disclosed, for example, in JP-A-60-80849 as an antistatic agent is preferred.

Matting agents, such as silica, magnesium oxide, barium strontium sulfate and poly(methyl methacrylate) can be included in the photographic emulsion layers or other hydrophilic colloid layers in the photographic materials of the present invention to prevent adhesion.

Dispersions of water insoluble or sparingly soluble synthetic polymers can be included in the photosensitive materials of the present invention to improve the film forming properties. For example, polymers in which alkyl(meth)acrylate, alkoxyalkyl(meth)acrylate, glycidyl(meth)acrylate, either individually or in combination, form the monomer units, or polymers in which combinations of these monomers with acrylic acid or methacrylic acid, for example, constitute the monomer units, can be used.

Gelatin is useful as a binding agent or a protective colloid for photographic emulsions, but other hydrophilic colloids can be used for this purpose. For example, gelatin derivatives, graft polymers of other polymers with gelatin, proteins such as albumin and casein, cellulose derivatives, such as hydroxyethylcellulose, carboxymethylcellulose and cellulose sulfate esters, sodium alginate, sugar derivatives such as starch derivatives, poly(vinyl alcohol), partially acetalated poly(vinyl alcohol), poly(N-vinylpyrrolidone), poly(acrylic acid), poly(methacrylic acid), polyacrylamide, polyvinylimidazole, and polyvinylpyrazole, can be used either as homopolymers or as copolymers with multivalent synthetic hydrophilic polymeric materials.

Acid treated gelatin can be used as well as lime treated gelatin, gelatin hydrolyzates and enzyme degradation products of gelatin.

Polymer latexes, such as alkyl acrylate latexes, can be included in the silver halide emulsion layers of the present invention.

Cellulose acetate, cellulose diacetate, nitrocellulose, polystyrene and poly(ethylene terephthalate), for example, can be used as supports for the photosensitive materials of the present invention. Excellent anti-static properties are important for COM films in particular and the use of supports which have good electric conductive properties is particularly preferred.

The inclusion of dihydroxybenzenes as the developing agent in the development baths which are used in the present invention is preferred, and the use of combinations of dihydroxybenzenes and 1-phenyl-3-pyrazolidones or combinations of dihydroxybenzenes and p-aminophenols is more preferred from the point of view of developing power.

Hydroquinone and chlorohydroquinone can be used as the dihydroxybenzene developing agents which can be used in the present invention, and hydroquinone is the most preferred.

1-Phenyl-3-pyrazolidone, 1-phenyl-,,4-dimethyl3-pyrazolidone and 1-phenyl-4-methyl-4-hydroxymethyl-3-pyrazolidone can be used as developing agents of the 1-phenyl-3-pyrazolidone or derivatives thereof which can be used in the present invention.

N-methyl-p-aminophenol, p-aminophenol and N-($\beta$-hydroxyethyl)-p-aminophenol can be used as the p-aminophenol based developing agents which can be used in the present invention and, among these, N-methyl-paminophenol is preferred.

Normally, the developing agent is used at a preferred concentration of 0.05 mol/liter to 0.8 mol/liter. Furthermore, in those cases in which combinations of dihydroxybenzenes and 1-phenyl-3-pyrazolidones or p-aminophenols are used, the dihydroxybenzenes are preferably used in a concentration of 0.05 to 0.5 mol/-liter, and the 1-phenyl-3-pyrazolidones or p-aminophenols are preferably used at a concentration of not more than 0.06 mol/liter.

Sodium sulfite, potassium sulfite, sodium bisulfite or potassium metabisulfite, for example, can be used as a sulfite preservative in the present invention. The sulfite is used at a concentration of at least 0.25 mol/liter.

The pH of the developing bath in the present invention is generally within the rage of 10.0 to 12.3, and it is preferably within the range of 10.3 to 11.8. In order to development-process the photographic material of the present invention under the condition having a pH of 11.5 or less. The usual water soluble inorganic alkali metal salts (for example, sodium hydroxide, sodium carbonate) can be used as the alkali to set the pH value.

Boric acid, the sugars (for example, saccharose) and oximes (for example, acetoxime) disclosed in JP-A-60-93433, phenols (for example, 5-sulfosalicylic acid) and triphosphate, for example, can be used as buffering agents in the developing baths for the present invention. Additives other than the above-mentioned components, include pH adjusting agents such as sodium hydroxide, potassium hydroxide, sodium carbonate and potassium carbonate; development inhibitors such as sodium bromide, potassium bromide and potassium iodide; organic solvents such as ethylene glycol, diethylene glycol and triethylene glycol; developing accelerators such as alkanolamines (e.g., diethanolamine and triethanolamine), amino compounds and imidazole and derivatives thereof described in JP-A-56-106244; anti-fogging agents such as mercapto based compounds (e.g., 1-phenyl-5-mercaptotetrazole), indazole based compounds (e.g., 5-nitroindazole) and benztriazole based compounds (e.g., 5-methylbenztriazole). If desired, in addition to the above additives, toners, surfactants, defoaming agents, hard water softening agents and film hardening agents may be contained in developing bath.

The fixing baths used in the present invention are aqueous solutions which contain fixing agents. Acid hardening agents, acetic acid and dibasic acids, for example, may also be added to the fixing bath.

The pH of the fixer bath is generally at least 3.8, and preferably 4.4 to 8.0.

Thiosulfates, such as sodium thiosulfate and ammonium thiosulfate, are indispensable components of the fixing bath, and ammonium thiosulfate is especially preferred in view of the fixing speed. The amount of fixing agent used can be varied appropriately, but it is generally from about 0.1 to about 5 mol/liter.

Water soluble aluminum salts are used as acid film hardening agents in the fixing baths in the present invention. The amount used is preferably from 0.01 to 0.2 mol/liter.

Tartaric acid and derivatives thereof, and citric acid and derivatives thereof, can be used individually or conjointly as the aforementioned dibasic acids. These compounds are effective when included in an amount of at least 0.005 mol per liter of the fixing bath.

Preservatives (for example, sulfites, bisulfites), pH buffers (for example, acetic acid, boric acid), pH adjusting agents (for example, sulfuric acid), chelating agents and potassium iodide can be included if desired in the fixing bath.

The developed and fixed photosensitive material is washed with water and dried.

The replenishment rate of the washing water is generally not more than 1200 ml/m$^2$, and preferably zero.

If the washing water (or stabilizing bath) replenishment rate is zero, it is a so-called reserved water washing system (i.e., a batch water washing system).

The isothiazoline based compounds disclosed by R.T. Kreiman in *J. Image. Tech.*, Vol. 10, No. 6242 (1984) and the isothiazoline compounds disclosed in *Research Disclosure*, (R.D.) Vol. 205, No. 20526 (May, 1981), for example, can also be used as microbiocides in the washing water or stabilizating baths. The compounds disclosed in *The Chemistry of Biocides and Fungicides*, by Horiguchi, Sankyo Shuppan (1982) and in *A Handbook of Biocidal and Fungicidal Techniques*, by the Japanese Biocide and Fungicide Society, Hakuhodo (1986), can also be included.

Moreover, water soluble surfactants and defoaming agents ma be added to prevent the formation of water bubble marks which are likely to be formed when washing with small quantities of water, and to prevent the transfer of processing agent components attached to the squeeze rollers, onto the processed film.

The development processing temperature and the fixing and water washing temperatures are generally 18° C. to 50° C. and preferably 25° C. to 43° C.

The present invention is especially suitable for rapid developing process in automatic processors (for example, those of the Slade type).

EXAMPLES

The invention is described below by illustrative examples, but the invention is not limited to these examples.

EXAMPLE 1

The emulsions A-1 to A-7 were obtained by the procedures outlined below.

Emulsion A-1 (For Comparison)

An aqueous solution of potassium bromide and an aqueous solution of silver nitrate were added simultaneously for 5 minutes to an aqueous gelatin solution which was being agitated vigorously at 75° C. in the presence of $2.5\times10^{-3}$ grams of 2-mercapto-3,4-methylthiazole per mol of silver. An octahedral silver bromide emulsion having an average grain size of 0.10 μm was obtained. Next, 115 mg of sodium thiosulfate and 115 mg of chloroauric acid (tetrahydrate) were added per mol of silver to this emulsion and a chemical treatment was carried out by heating the mixture to 75° C. for 50 minutes. The silver bromide grains obtained were taken as core grains and the shell grains were grown under the same precipitation conditions (i.e., the condition of forming grains) as used on the first occasion (i.e., the step for forming core grains) for a period of 40 minutes while the pAg value of the solution was controlled at 7.50. Ultimately a cubic mono-disperse core/shell silver bromide emulsion having an average grain size 0.25 μm was obtained. After washing the emulsion with water and desalting it, 3.4 mg of sodium thiosulfate and 3.4 mg of chloroauric acid (tetra-hydrate) were added to the emulsion per mol of silver. A chemical sensitization treatment was carried out by heating the emulsion to 75° C. for 60 minutes, and the internal latent image type silver halide emulsion A-1 was obtained.

Emulsions A-2 to A-4 (For Comparison) and A-5 to A-7 (Invention)

Emulsions A-2 to A-7 were prepared in the same way as emulsion A-1 except that the metal compounds shown in Table 1 were added to each emulsion during shell formation in the amounts shown in Table 1 per mol of silver.

TABLE 1

| Emulsion | Metal Compound | Amount Added |
|---|---|---|
| A-2 (Comp. Ex.) | Ferrous chloride | $6.7\times10^{-5}$ mol |
| A-3 (Comp. Ex.) | Ferric oxalate | $6.7\times10^{-5}$ mol |
| A-4 (Comp. Ex.) | Ferrous sulfate | $6.7\times10^{-5}$ mol |
| A-5 (Invention) | Potassium ferrocyanide | $6.7\times10^{-5}$ mol |
| A-6 (Invention) | Potassium ferricyanide | $6.7\times10^{-5}$ mol |

TABLE 1-continued

| Emulsion | Metal Compound | Amount Added |
|---|---|---|
| A-7 (Invention) | EDTA Iron salt | $6.7\times10^{-5}$ mol |

In order to investigate the reversal photographic characteristics of the above-mentioned emulsions, the Emulsions A-1 to A-7 were divided. Then, $2.5\times10^{-6}$ mol/mol·Ag of Illustrative Compound (I-2) as nucleating agent, $8.7\times10^{-4}$ mol/mol·Ag of Illustrative Compound (II-1) as a nucleating accelerator, and $1.2\times10^{-3}$ mol/mol·Ag of Illustrative Compound (III-6) as a sensitizing dye were added to the emulsions. Also added were 10 mg/m$^2$ of 4 hydroxy-6-methyl-1,3,3,3a-tetraazaindene and 4.1 mg/m$^2$ of 5-methylbenzotriazole as stabilizers and 56 mg/m$^2$ of 1,3-divinylsulfonyl-2-propanol as a film hardening agent. Finally, 50 mg/m$^2$ of barium strontium sulfate having an average particle size of 1.0 μm as matting agent, 50 mg/m$^2$ of hydroquinone, 20 mg/m$^2$ of the compound of structural formula (1) below, Sodium P-dodecylbenzene sulfonate as coating aids and the surfactant of structural formula (2 indicated below were added to a gelatin solution to form a surface protective layer. Coated Samples 1 to 7 were prepared by coating this protective layer at the same time as the emulsion layer onto a poly(ethylene terephthalate) film so as to provide a coated silver content of 1.6 g m$^2$.

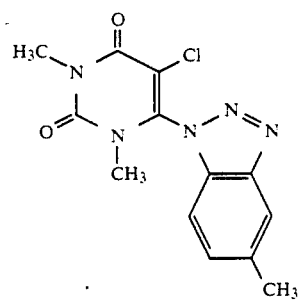

(1)

$$C_8F_{17}SO_2\underset{\underset{C_3H_7}{|}}{N}CH_2COOK \qquad (2)$$

These samples were exposed for $1\times10^{-4}$ seconds through a continuous wedge using a $3.75\times10^5$ Lux xenon flash light.

Each sample was then developed for 30 seconds at 35° C. in a Proster Plus developer (pH=10.56) manufactured by Eastman Kodak Company and then stopped, fixed and washed in the usual way, and positive images were obtained. The results obtained are shown in Table 2, in which $D_{max}$ signifies the maximum density of the reversal image, $D_{min}$ signifies the minimum density, and Sp-df signifies the mid-point speed. The expression "$\Delta\log E_{0.2}$" represents the difference between the foot-sensitive points (i.e., the logarithm values of the exposure amount which gives a density of $D_{min}+0.2$) of the reversal positive image and the re-reversal negative image. Furthermore, $\Delta\log E_{0.2}$ is defined by the log E value difference for the difference between the reversal speed which gives a density of $D_{min}+0.2$ and the re-reversal speed which gives a density of $D_{min}+0.2$, and it is called the speed amplitude. It is clear from the definition that the re-reversal negative is less likely to appear when the speed amplitude is large.

TABLE 2

| Sample No. | Emulsion | $D_{max}$ | $D_{min}$ | Sp-df | $\Delta\log E_{0.2}$ |
|---|---|---|---|---|---|
| 1 (Comp. Sam.) | A-1 | 2.50 | 0.07 | 1.77 | 1.10 |
| 2 (Comp. Sam.) | A-2 | 2.10 | 0.06 | 1.78 | 1.30 |
| 3 (Comp. Sam.) | A-3 | 2.05 | 0.07 | 1.70 | 1.35 |
| 4 (Comp. Sam.) | A-4 | 2.11 | 0.06 | 1.73 | 1.25 |
| 5 (Invention) | A-5 | 2.40 | 0.05 | 1.88 | 2.11 |
| 6 (Invention) | A-6 | 2.35 | 0.05 | 1.85 | 2.00 |
| 7 (Invention) | A-7 | 2.36 | 0.05 | 1.84 | 1.95 |

It is clearly seen from the results of Table 2 that Comparative Samples 2 to 4 which contained iron salts had a much lower $D_{max}$ than the Control Sample 1, and that the photographic properties of the comparative samples were not good with respect to their $D_{min}$, Sp-df and $\Delta\log E_{0.2}$ figures. On the other hand, it can be seen that Samples 5 to 7 which contained iron complex compounds and which were embodiments of the present invention had a lower $D_{max}$ than the Control Sample 1, a lower $D_{min}$, a higher Sp-df value and a much larger $\Delta\log E_{0.2}$ values. Further, they exhibited good photographic performance. The effect of reducing the re-reversal negative image was clearly pronounced. Furthermore, the effect of potassium ferrocyanide was clearly pronounced among the iron complex compounds.

EXAMPLE 2

Samples 1 to 6 were coated in the same way as in Emulsion A-1 of Example 1 except that the amounts of potassium ferrocyanide shown in Table 3 per mol of silver were added during shell formation. The samples were exposed and processed, and the results obtained are shown in Table 4.

TABLE 3

| Sample No. | Amount Added (mol) |
|---|---|
| 1 (Comp. Ex.) | 0 |
| 2 (Invention) | $6.7 \times 10^{-7}$ |
| 3 (Invention) | $6.7 \times 10^{-6}$ |
| 4 (Invention) | $6.7 \times 10^{-5}$ |
| 5 (Invention) | $3.7 \times 10^{-4}$ |
| 6 (Invention) | $6.7 \times 10^{-4}$ |

TABLE 4

| Sample No. | $D_{max}$ | $D_{min}$ | Sp-df | $\Delta\log E_{0.2}$ |
|---|---|---|---|---|
| 1 (Comp. Ex.) | 2.50 | 0.07 | 1.77 | 1.10 |
| 2 (Invention) | 2.50 | 0.07 | 1.78 | 1.20 |
| 3 (Invention) | 2.45 | 0.06 | 1.83 | 1.65 |
| 4 (Invention) | 2.40 | 0.05 | 1.88 | 2.11 |
| 5 (Invention) | 2.37 | 0.05 | 1.89 | 2.30 |
| 6 (Invention) | 2.20 | 0.04 | 1.90 | 2.50 |

It is clearly seen from the results of Table 4 that samples to which potassium ferrocyanide had been added according to the present invention exhibit good photographic performance in that there is a pronounced reduction in the re-reversal negative image in comparison to the fall in $D_{max}$ as the amount of ferrocyanide added is increased.

However, if too much potassium ferrocyanide is added there is the disadvantage that the maximum image density $D_{max}$ falls, and so it is desirable that the preferred amount should be added to the emulsion.

EXAMPLE 3

Preparation of Comparative Emulsions B-1 and C-1

An aqueous solution of potassium bromide and an aqueous solution of silver nitrate were added simultaneously for 5 minutes to an aqueous gelatin solution which was being agitated vigorously at 75° C. in the presence of thioether. An octahedral silver bromide emulsion having an average grain size of 0.10 μm was obtained. Next, 38 mg of sodium thiosulfate and 38 mg of chloroauric acid (tetrahydrate) were added per mol of silver to this emulsion and a chemical sensitization treatment was carried out by heating the mixture to 75° C. for 50 minutes. The silver bromide grains so obtained were taken as core grains and the shell grains were grown by treating under the same precipitation conditions (i.e., the condition of forming grains) as used on the first occasion (i.e., the step for forming core grains) for 40 minutes. The pAg value of the solutions were controlled at 8.20 and 7.70, respectively. Ultimately octahedral and tetradecahedral monodisperse core/-shell silver bromide emulsions having average grain size of 0.25 μm were obtained. After washing the emulsions with water and desalting them, 6.0 mg of sodium thiosulfate and 6.0 mg of chloroauric acid (tetra-hydrate) were added to the emulsions per mol of silver, and a chemical sensitization treatment was carried out by heating them to 75° C. for 60 minutes. Internal latent image type silver halide Emulsions B-1 and C-1 were obtained. The proportion of the surface of all the grains contained in each emulsion accounted for by the 100 plane was measured using the method described in *Journal of Imaging Science*, 29: 165 (1985). The rest of the surface was (111) plane. Thus, Emulsion B-1 contained tetradecahedral grains and Emulsion C-1 contained octahedral grains.

| Emulsion | Percentage of (100) Plane |
|---|---|
| B-1 | 85 |
| C-1 | 15 |

Emulsions B-2 to B-4 and C-2 to C-4 (For Comparison) and B-5 to B-7 and C-5 to C-7 (This Invention)

Emulsions B-2 to B-7 and C-2 to C-7 were prepared in the same way as Emulsions B-1 and C-1 except that the metal compounds shown in Table 5 were added in the amounts shown per mol of silver to each emulsion during shell formation. Emulsions B-2 to B-7 contained tetradecahedral grains, and Emulsions C-2 to C-7 contained octahedral grains.

TABLE 5

| Emulsion | Metal Compound | Amount Added |
|---|---|---|
| B-2, C-2 (Comp. Ex.) | Ferrous chloride | $6.7 \times 10^{-5}$ mol |
| B-3, C-3 (Comp. Ex.) | Ferric oxalate | $6.7 \times 10^{-5}$ mol |
| B-4, C-4 (Comp. Ex.) | Ferrous sulfate | $6.7 \times 10^{-5}$ mol |
| B-5, C-5 (Invention) | Potassium ferrocyanide | $6.7 \times 10^{-5}$ mol |
| B-6, C-6 (Invention) | Potassium ferricyanide | $6.7 \times 10^{-5}$ mol |
| B-7, C-7 (Invention) | EDTA iron salt | $6.7 \times 10^{-5}$ mol |

In order to investigate the reversal photographic characteristics of the above mentioned emulsions, the emulsions were divided and coated in the same way as in Example 1 except that a poly(ethylene terephthalate) base which had an under layer which contained tin oxide ($SnO_2$) (and which had a specific resistance of $10^8$ Ωcm at a relative humidity of 10% or less) was used (Samples 1 to 14). These samples were exposed and processed.

The results obtained are shown in Table 6.

TABLE 6

| Sample No. | Emulsion | $D_{max}$ | $D_{min}$ | Sp-df | $\Delta logE_{0.1}$ |
|---|---|---|---|---|---|
| 1 (Comp. Ex.) | B-1 | 2.40 | 0.06 | 1.65 | 1.20 |
| 2 (Comp. Ex.) | C-1 | 2.35 | 0.06 | 1.67 | 1.35 |
| 3 (Comp. Ex.) | B-2 | 2.00 | 0.06 | 1.70 | 1.40 |
| 4 (Comp. Ex.) | C-2 | 1.95 | 0.06 | 1.69 | 1.50 |
| 5 (Comp. Ex.) | B-3 | 1.95 | 0.06 | 1.71 | 1.38 |
| 6 (Comp. Ex.) | C-3 | 1.80 | 0.06 | 1.66 | 1.52 |
| 7 (Comp. Ex.) | B-4 | 1.75 | 0.06 | 1.64 | 1.41 |
| 8 (Comp. Ex.) | C-4 | 1.80 | 0.06 | 1.65 | 1.49 |
| 9 (Invention) | B-5 | 2.30 | 0.05 | 1.75 | 2.20 |
| 10 (Invention) | C-5 | 2.25 | 0.05 | 1.76 | 2.34 |
| 11 (Invention) | B-6 | 2.25 | 0.05 | 1.77 | 2.18 |
| 12 (Invention) | C-6 | 2.20 | 0.05 | 1.73 | 2.25 |
| 13 (Invention) | B-7 | 2.24 | 0.05 | 1.74 | 2.10 |
| 14 (Invention) | C-7 | 2.18 | 0.05 | 1.75 | 2.20 |

It is clearly seen from the results of Table 6 that, in comparison to Comparative Samples 3 to 8, the Samples 9 to 14 which contained iron complex compounds and are embodiments of the present invention exhibit good photographic performance. Specifically, the fall in $D_{max}$ was small, Sp-df was high, $D_{min}$ was low and the re-reversal negative image was markedly reduced, even if tetradecahedral grains and octahedral grains were contained.

EXAMPLE 4

Illustrative Compound (III-11), a sensitizing dye, was added at the rate of $4.9\times10^{-4}$ mol/mol·Ag and the compound of structural formula (3) indicated below was added at a rate of $1.4\times10^{-3}$ mol/mol·Ag to Emulsion A-5 of the present invention. The nucleating agent (Illustrative Compound (I-8)) was then added at a rate of $3.3\times10^{-6}$ mol/mol·Ag after adjusting the pH of the emulsion to 5.3. Finally, ethylenediamine tetra-acetic acid was added at a rate of 3.1 mg/m$^2$ as an anti-metal spotting agent, and 118 mg/m$^2$ of 2-bis(vinylsulfonylacetamide)-ethane was added as a film hardening agent.

50 mg/m$^2$ of barium strontium sulfate having an average particle size 1.0 μm, 60 mg/m$^2$ of liquid paraffin, 250 mg/m$^2$ of methanol silica acting as matting agent, 4.3 mg/m$^2$ of "Proxel" acting as fungicide, sodium p-dodecylbenzenesulfonate acting as a coating aid and 4.6 mg/m$^2$ of the fluorine-based surfactant of structural formula (2) in Example 1 were mixed. This mixture was coated together with the emulsions using a simultaneous coating method onto a poly(ethylene terephthalate) base. The base had an under-layer which contained tin oxide ($SnO_2$) (having a specific resistance of $10^8$ Ωcm at a relative humidity of 10% or less) in such a way that the silver was coated at a rate of 1.8 g/m$^2$.

(3)

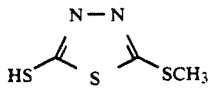

Moreover, the base used in this example had a backing layer and a backing protective layer having the composition indicated below to prevent the occurrence of low humidity curling and for anti-halation purposes.

| Backing Layer | |
|---|---|
| Gelatin | 0.9 g/m$^2$ |
| Dye (a) | 70 mg/m$^2$ |
| Surfactant (structural formula (4) below) | 15 mg/m$^2$ |

-continued

| | |
|---|---|
| 1,3-Vinylsulfonyl-2-propanol | 130 mg/m$^2$ |
| Sodium p-dodecylbenzenesulfonate | 23 mg/m$^2$ |
| "Proxel" | 3 mg/m$^2$ |

Dye (a)

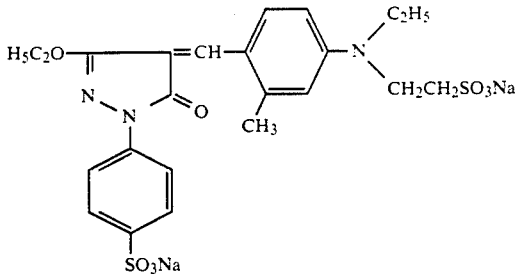

(4) $CH_2COOC_6H_{13}$
|
$CHCOOC_6H_{13}$
|
$SO_3Na$

| Backing Protective Layer | |
|---|---|
| Gelatin | 0.8 g/m$^2$ |
| Barium strontium sulfate | 220 mg/m$^2$ |
| Liquid paraffin | 310 mg/m$^2$ |
| Surfactant (Structural Formula (4)) | 12 mg/m$^2$ |
| Fluorine based surfactant (Structural Formula (2)) | 5 mg/m$^2$ |
| "Proxel" | 3 mg/m$^2$ |

The sample obtained was exposed in the same way as described in Example 1 and then it was processed for 30 seconds at 37° C. by the developing baths indicated below using a "Kodel" automatic processor (made by the Cordel Co., U.S.)

| Developing Bath A | |
|---|---|
| EDTA.2Na.2$H_2O$ | 5.0 g/l |
| $Na_2SO_3$ | 120.0 g/l |
| Hydroquinone | 30.0 g/l |
| Metol | 7.0 g/l |
| N-Methylaminoethanol | 60.0 g/l |
| KBr | 2.0 g/l |
| 5-Methylbenzotriazole | 30.0 mg/l |
| Water to make | 1 liter |
| Adjusted to pH 11.0 with NaOH | |
| **Developing Bath B** | |
| EDTA.2Na.2$H_2O$ | 1.0 g/l |
| $Na_2SO_3$ | 70.0 g/l |
| Hydroquinone | 22.0 g/l |
| 4-Hydroxymethyl-1-phenyl-3-pyrazolidone | 3.0 g/l |
| KBr | 10.0 g/l |
| 2,5-Dimercapto-1,3,4-thiadiazole | 40.0 mg/l |
| Water to make | 1 liter |

The results indicated the excellent positive characteristics similar to those in Examples 1 to 3 had been obtained. From these results it can be concluded that direct positive silver halide photographic materials of the present invention have excellent processing bath adaptability.

EXAMPLE 5

Samples 5 to 7 as used in Example 1 were exposed in the same way as described in Example 1, developed for 30 seconds a 35° C. using the developing baths indicated below and, on stopping, fixing and washing in the usual way, excellent positive characteristics similar to those in Examples 1, 2 and 3 were obtained.

| Developing Baths | |
|---|---|
| FR Company | FR Data Com-Pak Negative (pH = 10.82) |
| ALTA Company | Datagraphix Auto Pos Chem Kit (pH = 11.08) |

From these facts it can be concluded that the direct positive silver halide photographic photosensitive materials of the present invention have excellent processing bath adaptability.

While the invention has been described in detail and with reference to specific embodiments thereof, it will be apparent to one skilled in the art that various changes and modifications can be made therein without departing from the spirit and scope thereof.

We claim:

1. A direct positive silver halide photographic material comprising a support having thereon at least one internal latent image silver halide emulsion layer which has not been pre-fogged and another hydrophilic colloid layer, wherein the grains in said internal latent image silver halide emulsion are formed in the presence of an iron complex compound which is potassium ferrocyanide, potassium ferricyanide, or an EDTA iron complex salt.

2. The direct positive silver halide photographic material as claimed in claim 1, wherein a nucleation agent and a nucleation accelerator are present in the internal latent image silver halide emulsion layer or another hydrophilic colloid layer.

3. The direct positive silver halide photographic material as claimed in claim 1, wherein the iron complex compound is added in an amount of $1\times10^{-9}$ to $1\times10^{-2}$ mol per mol of silver halide.

4. The direct positive silver halide photographic material as claimed in claim 2, wherein the nucleating agent is represented by formula [I];

[I]

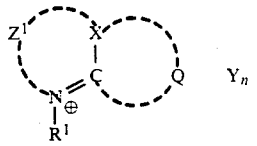

wherein $Z^1$ represents a groups of non-metal atom which is required to form a five or six membered heterocyclic ring; $R^1$ represents an aliphatic group; X represents $$=\underset{|}{C}- \quad \text{or} \quad -\underset{|}{N}-;$$

Q represents a group of non-metal atoms which is required to form a four to twelve membered non-aromatic hydrocarbon ring or non-aromatic heterocyclic ring, provided that at least one of the substituent groups of $R^1$ and $Z^1$ and of the substituent group of Q contains an alkyl group; Y represents a counter ion for balancing the electrical charge; n is the number of counter ions required to balance the electrical charge.

5. The direct positive silver halide photographic material as claimed in claim 2, wherein the nucleation accelerator is selected from the group consisting of the following compounds (II-1) to (II-9):

(II-1)

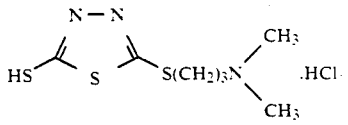

(II-2)

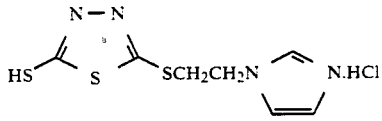

(II-3)

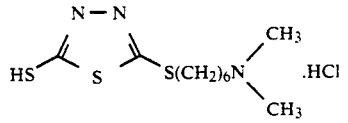

(II-4)

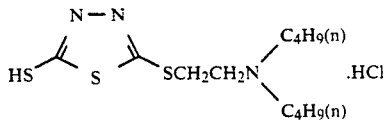

(II-5)

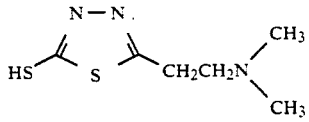

(II-6)

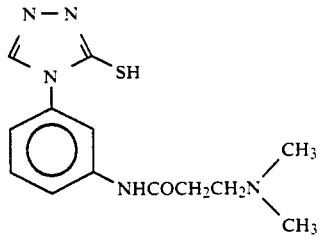

(II-7)

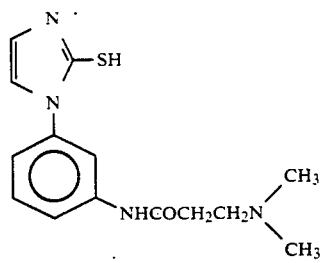

(II-8)

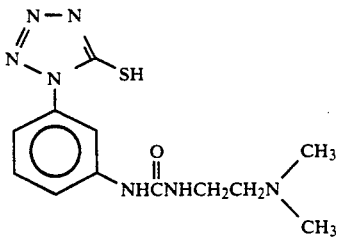

(II-9)

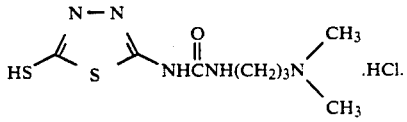

6. A method for processing a direct positive silver halide photographic material comprising a support having thereon at least one internal latent image type silver halide emulsion layer which has not been prefogged and another hydrophilic colloid layer, said direct positive silver halide photographic material being developed at a pH of 11.5 or less, wherein the grains in said internal latent image silver halide emulsion is formed in the presence of an iron complex compound which is potassium ferrocyanide, potassium ferricyanide or an EDTA iron complex salt.

* * * * *